US005357704A

United States Patent [19]

Benkovic

[11] Patent Number: 5,357,704

[45] Date of Patent: Oct. 25, 1994

[54] FIREARM LOCK

[75] Inventor: Ivan Benkovic, Sydney, Australia

[73] Assignee: PIP Industrial Services Pty, Ltd., New South Wales, Australia

[21] Appl. No.: 70,429

[22] PCT Filed: Oct. 9, 1991

[86] PCT No.: PCT/AU91/00465

§ 371 Date: Jun. 8, 1993

§ 102(e) Date: Jun. 8, 1993

[87] PCT Pub. No.: WO92/06345

PCT Pub. Date: Apr. 16, 1992

[30] Foreign Application Priority Data

Oct. 9, 1990 [AU] Australia ..... PK2728

[51] Int. Cl.[5] ..... F41A 17/02; F41A 17/44

[52] U.S. Cl. ..... 42/70.11; 42/66

[58] Field of Search ..... 42/66, 70.01, 70.11, 42/90

[56] References Cited

U.S. PATENT DOCUMENTS

| | | | |
|---|---|---|---|
| 2,327,334 | 8/1943 | Parker | 42/70.11 |
| 2,479,107 | 8/1949 | Garretson | 42/70.11 |
| 2,763,081 | 9/1956 | Huckabee | 42/70.11 |
| 2,887,807 | 5/1959 | Santangelo | 42/70.11 |
| 4,023,294 | 5/1977 | Knopp | 42/70.11 |
| 4,398,366 | 8/1983 | Wernicki | 42/70.11 |

FOREIGN PATENT DOCUMENTS

| | | |
|---|---|---|
| 2635581 | 2/1990 | France . |
| 2082293A | 3/1982 | United Kingdom . |
| 2220253A | 1/1990 | United Kingdom . |

*Primary Examiner*—Stephen C. Bentley

*Attorney, Agent, or Firm*—Woodcock Washburn Kurtz Mackiewicz & Norris

[57] ABSTRACT

A gun lock including a hardened steel rod (14) threaded at each end, the threaded ends respectively engaging a cartridge shaped plug (27) and a rotatable tumbler lock (24). The lock (24) is fixed within a sleeve body (21) adapted to fit snugly around a barrel end (12) of a gun to be locked. The cartridge plug (27) fits snugly within the firing chamber (11) of the gun, in the same manner as a cartridge adapted to be fired within the gun. With the cartridge plug (27) within the firing chamber (11), and with the rod (14) threadedly engaged in the lock (24) the rod (14) can be inserted down the bore (13) of the gun and threadedly the cartridge plug (27) by rotating a mating key engaged in the lock (24), until the device is snug. Removal of the key results in securing the gun lock within the gun. A slot (26) within the sleeve body (21) engages an aiming sight (25) of the gun so as to prevent rotation of the sleeve (21). The end of rod (14), rather than being threaded, may include a circumferential groove which can be lockingly engaged by a set of wedge driven diametrically restricting detent balls, the wedge driving mechanism being threadedly driven by the lock (24) within an alternative arrangement of the sleeve body (21).

4 Claims, 2 Drawing Sheets

FIREARM LOCK

BACKGROUND TO THE INVENTION

This invention relates to a device which may be used to lock in an inoperative state a rifle, pistol or similar firearm.

There is an ever growing pressure to limit the misuse of firearms in the general public. The lack of a secure, yet reasonably priced, gun lock, has to a large extent hampered serious efforts in addressing the problem.

In essence the present invention provides a gun lock which engages the end face of a gun bolt, or corresponding component in the normal manner by which the bolt engages the rear of a cartridge for the purposes of ejection of the cartridge.

SUMMARY OF THE INVENTION

Accordingly, in one broad form, the present invention may be said to consist in a gun lock comprising:

an inextendible rod means sized to be inserted along the bore of a gun barrel;

a first end member fixable to a first end of the rod means and being sized and shaped so as to reside in a firing chamber of the gun in the manner of a cartridge;

and a second end member lockably securable to a second end or proximate portion of the rod means at a distance from the first end member approximately equal to the length of the bore such that with the rod means disposed within the bore, the first end member residing within the firing chamber and fixed to the rod means and the second end member secured to the rod means, the first end member cannot be withdrawn from the firing chamber.

It is preferred that the rod means is a hardened metal rod and that the first end member is threadedly attached to said rod and is shaped to the same shape and dimensions as a standard cartridge to be used in the gun intended to be locked by the gun lock.

It is also preferred that the second end member is securable to the second end of the rod means by actuation of a key, or similar device, and that when the key is released the rod can be rotatably detached from the first end member by rotation of a tumbler means of the second end member.

Preferably the second end member includes a sleeve means with a notch means so as to non-rotatably engage an end length of the gun, the lockable tumbler means engaging within the sleeve means.

In an alternative, especially adapted for guns having a plain barrel end, the second end member includes a plain sleeve means so as to engage an end length of the barrel and an internal contracting means, such as wedge driven detent balls, for lockably holding the second end of the rod, the second end of the rod preferably having a groove proximate its end for accepting the contracting means such as the detent balls. In such embodiment the first end member may be permanently fixed to the rod means, or it may be threadedly engaged such as is described above.

By way of example only, the following description will allow the reader to better understand the invention, and how it may be put into use, by reference to the accompanying drawings in which:

DESCRIPTION OF BEST MODE OF CARRYING OUT THE INVENTION

Figure 1:
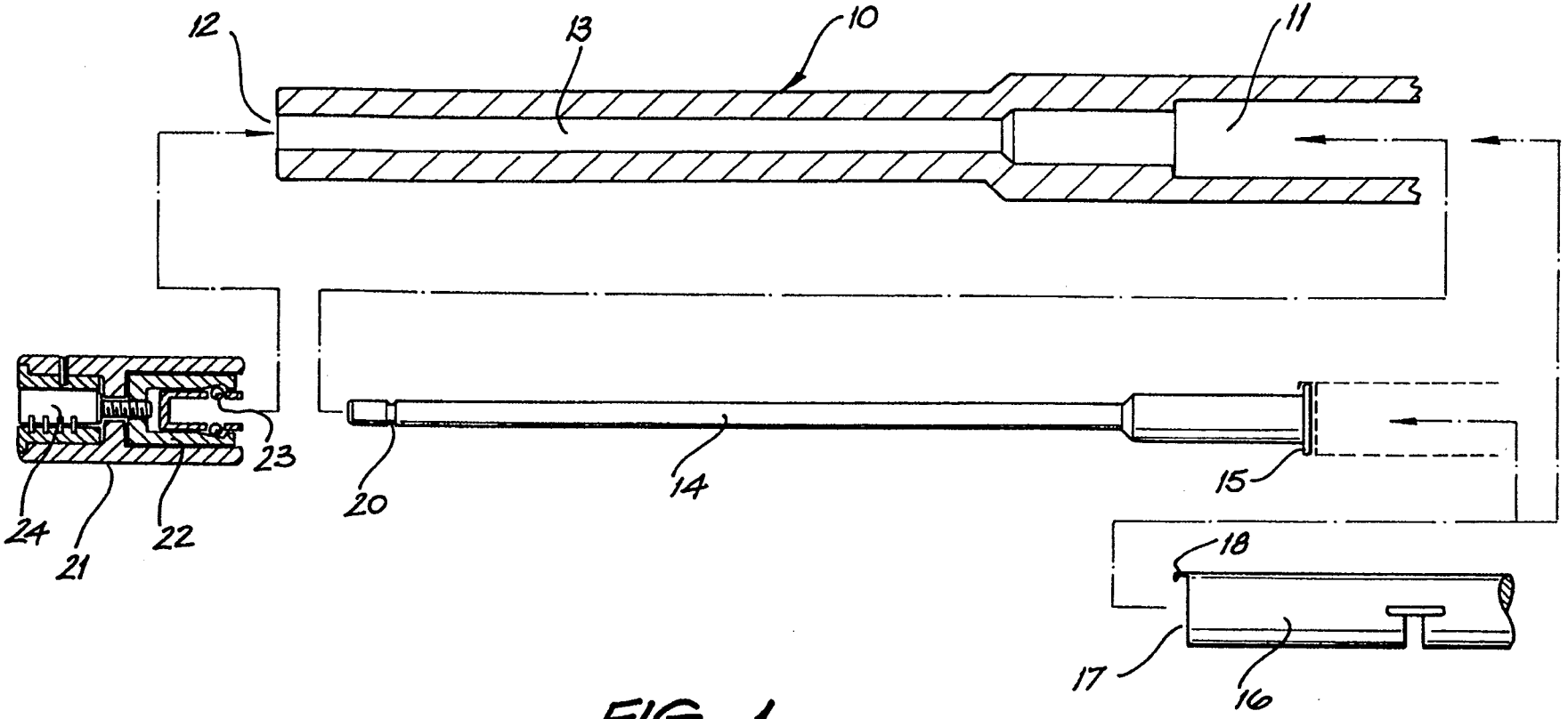
FIG. 1 is a partially sectioned, disassembled view of a gun lock and a portion of a corresponding gun.

A gun barrel 10 is shown in FIG. 1 in side sectioned view and includes a cartridge chamber 11 which receives a cartridge during a firing operation, a bore 13 along which the projectile passes, and the barrel end 12 where the projectile leaves the gun.

The gun also includes a bolt, or similar cartridge loading/ejection device, 16. The bolt 16 is slidingly held in the gun so that its front face 17 can be extended into, and reversed out of, the cartridge chamber 11. The front face 17 is forced firmly up behind a cartridge to be fired and locked in place before firing, and the ejection claw 18 grips the rim, or corresponding structure, of the fired cartridge so as to drag the cartridge rearwardly for ejection after firing. The ejection claw 18 is normally pivoted to the front face 17 but in the firing position it is locked firmly in place so as to ensure a firm reliable grip on the cartridge rim for the purpose of ejecting the cartridge after firing.

This general structure of the barrel 10 and bolt 16 are well known and will vary in detailed design from one gun to another. The structures are common in a large variety of guns ranging from side arms to naval guns.

The lock comprises a hardened steel rod 14 with a locking rim 15 integral of one end of the rod. The locking rim 15 is sized and shaped the same as the rim and cartridge end of a cartridge adapted to be fired by the gun intended to be locked. As seen in dotted outline the rim 15 is engaged by the bolt 16 by way of the ejection claw 18 engaging the rim 15 in the same manner as it engages the rim of a live cartridge.

The opposite end of the rod 14 includes a groove 20, the tip of the rod 14 being insertable into a lock body 21. By inserting a correct key into the actual lock 24, and by turning the key, an internally tapered barrel 22 is screwed down towards the rod 14 and diametrically compresses the caged locking balls 23. As the key is turned the lock body 21 is accurately positioned, by feeling resistance in the key, so that the locking balls 23 move into the reduced section of groove 20. Upon removing of the key the lock is then engaged with the rod 14. In order to lock the gun the disassembled rod 14 is inserted, following the arrow, in through the cartridge chamber 11 and along the bore 13. Before the rim 15 fully enters the barrel the ejection claw 18 is engaged with the rim 15. The rod 14 is then fully inserted by inserting the bolt 16 to the usual firing position.

The tip of the rod 14 with the groove 20 is slightly exposed outside the end 12 of the barrel. The lock body 21 is then locked to the rod 14 in the manner described above, the key removed, and the gun made secure and inoperative.

In this locked state the locking device cannot be removed, nor in fact the bolt removed, without damaging at least some component of the gun which will leave the gun inoperative.

To unlock the gun, the reverse procedure is followed.

One clear advantage of this locking device is that it renders the gun inoperative even when the gun is being transported. Additionally, by providing a secure fitting to the lock body 21, or by providing a rigid member through which the gun barrel 10 can be inserted but through which the lock body 21 will not pass, the secured gun can additionally be locked in a fixed safe or other secure location.

Figure 2:
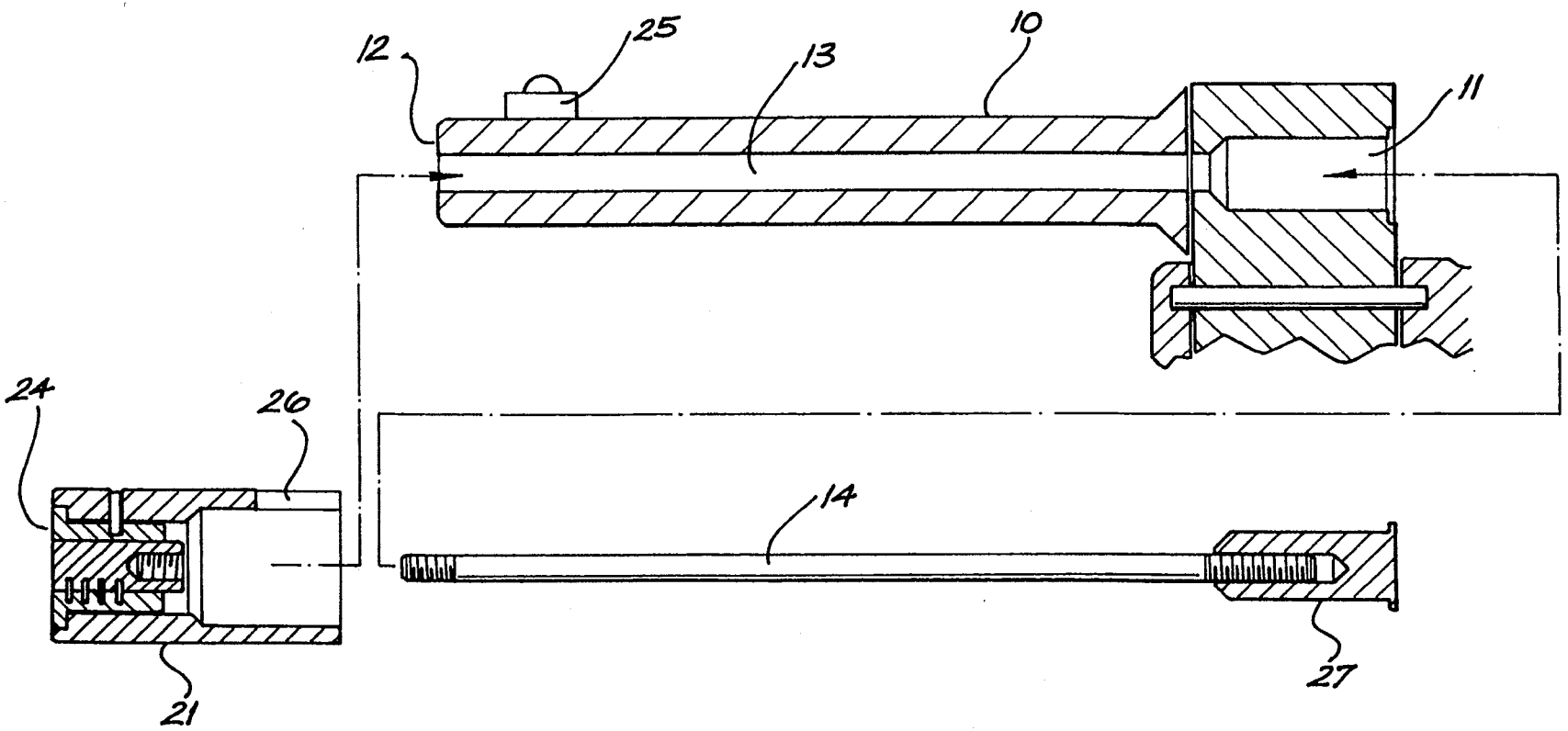
FIG. 2 is a view similar to that of FIG. 1, but for an alternative embodiment.

The gun shown in FIG. 2 includes a barrel 10, cartridge chamber 11, barrel end 12 and bore 13, generally as described above, but is in the typical form of a revolver. Proximate the barrel end 12 is a sight 25.

The gun lock itself includes three separable components, a sleeve body 21, a rod 14, and a cartridge end 27. The rod 14 is of hardened steel and is threaded at both ends. At one end of the rod 14 the thread engages a corresponding thread within the cartridge end 27 while the thread on the other end of the rod 14 engages a corresponding thread within the rotatable center of the lock 24. The lock 24 is a proprietary item including a central tumbler and a surrounding sleeve, the sleeve being pinned or screwed in a fixed relationship within the sleeve body 21. Thus by inserting an appropriate key the lock 24 can be rotated in an appropriate direction to either screw or unscrew the rod 14.

The cartridge end 27 is externally shaped substantially the same as a cartridge which could be fired in the gun and therefore fits snugly within the firing chamber 11.

The lock of FIG. 2 is installed by threading rod 14 into the lock 24, by placing the cartridge end 27 in the firing chamber 11 that is aligned with the bore 13, and by inserting the rod 14 down the bore 13 so as to engage the cartridge end 27. With the key inserted into the lock 24, the lock 24 is turned in the direction to threadedly engage the rod 14 with the cartridge end 27, until rotating resistance becomes firm, the lock can then be rotated back sufficiently to withdraw the key, leaving the gun securely locked. In this position the sleeve 21 will have been placed over and partially along the barrel end 12 with a slotted portion 26 of the sleeve 21 fitting around the sight 25. This then prevents the rotation of the sleeve 21 relative to the barrel 10, and in the absence of a suitable key it therefore prevents rod 14 from being unscrewed from the cartridge end 27.

The rod 14 might be engaged within lock 24 by an alternative means, or the threaded engagement between the rod 14 and the lock 24 might be temporarily fixed by a thread locking solution.

To unlock the gun, the reverse procedure is followed.

In both cases it will be appreciated that the portion of the lock occupying the firing chamber 11, that is the cartridge end 27 (FIG. 2) and the enlarged end of rod 14 proximate the locking rim 15, cannot be withdrawn up the bore 13 as it is diametrically far too large.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

I claim:

1. A firearm lock, comprising:

an inextendable rod means sized to be received through a bore of a gun barrel, the rod means having first and second ends, the first end of the rod means having a circumferential groove;

a first end member fixed to the first end of the rod means and being sized and shaped so as to reside in a firing chamber of the gun in the manner of a cartridge; and a second end member being lockably securable proximate the second end of the rod means at a distance from the first end member approximately equal to the length of the bore, the second member having a plurality of locking balls, a wedge means and a lockable screw drive means for engaging the wedge means to drive the locking balls radially inwardly relative the second end of the rod means to engage the locking balls in the groove;

wherein with the rod means disposed within the bore, the first end member residing within the firing chamber and the second end member secured to the rod means, the first end member cannot be withdrawn from the firing chamber.

2. The firearm lock of claim 1, wherein:

the locking balls are retained in the second end member so as to lie in a plane and be generally equally radially spaced from a central axis normal to the plane;

the wedge means is in the form of a cylindrical member having an internal tapered portion which surrounds and is adjacent to the locking balls; and the lockable screw drive means moves the cylindrical member along the central axis so that the locking balls are acted on by the tapered portion to effect the radial movement of the locking balls.

3. The firearm lock of claim 1, wherein the rod means is a hardened metal rod and the first end member is threadably attached to the rod and is shaped to correspond to the shape and dimension of a standard cartridge to be used in the gun.

4. The firearm lock of claim 1, wherein the first end member is integral with the rod means.

* * * * *